United States Patent [19]

Moura

[11] 4,269,679

[45] May 26, 1981

[54] PROCESS FOR ENGRAVING METAL PLATES TO BE USED AS PATTERNS FOR TEXTURIZED PRODUCTS

[75] Inventor: Joao B. Moura, Jundiai, Brazil

[73] Assignee: Duratex S.A., Sao Paulo, Brazil

[21] Appl. No.: 61,242

[22] Filed: Jul. 27, 1979

[30] Foreign Application Priority Data

Jan. 31, 1979 [BR] Brazil ..... PI 7900616

[51] Int. Cl.[3] ..... C25F 3/06; C25F 3/14

[52] U.S. Cl. ..... 204/129.65; 204/129.75

[58] Field of Search ..... 204/129.65, 129.75

[56] References Cited

U.S. PATENT DOCUMENTS

| | | | |
|---|---|---|---|
| 1,275,408 | 8/1918 | Eaton | 204/129.65 |
| 1,362,159 | 12/1920 | Weeks | 204/129.65 |
| 2,888,391 | 5/1959 | Loughman | 204/129.65 |

FOREIGN PATENT DOCUMENTS

| | | | |
|---|---|---|---|
| 868 | of 1854 | United Kingdom | 204/129.65 |

OTHER PUBLICATIONS

The Production of Printed Circuits and Electronic Assemblies, Edited by C. R. Draper, 1969 pp. 50–60.

*Primary Examiner*—T. M. Tufariello
*Attorney, Agent, or Firm*—Darby & Darby

[57] ABSTRACT

A process for engraving metal plates to be used as patterns for texturized products, in which the pattern to be reproduced is formed on a silk screen, the pattern formed on the screen is transferred to the previously roughened surface of the metal plate to be engraved by an acid-resistant paint, and the metal plate is subjected to electro-erosion in an inorganic acid bath, using as one electrode the metal plate itself, and as another electrode a plate of the same material or another material. When different engraving depths are required, the process is interrupted, with the already engraved portions being covered with the acid-resistant paint, and the uncovered portions being subjected to an electro-erosion engraving, this sequence being repeated until obtaining all depths required in the pattern desired.

2 Claims, 1 Drawing Figure

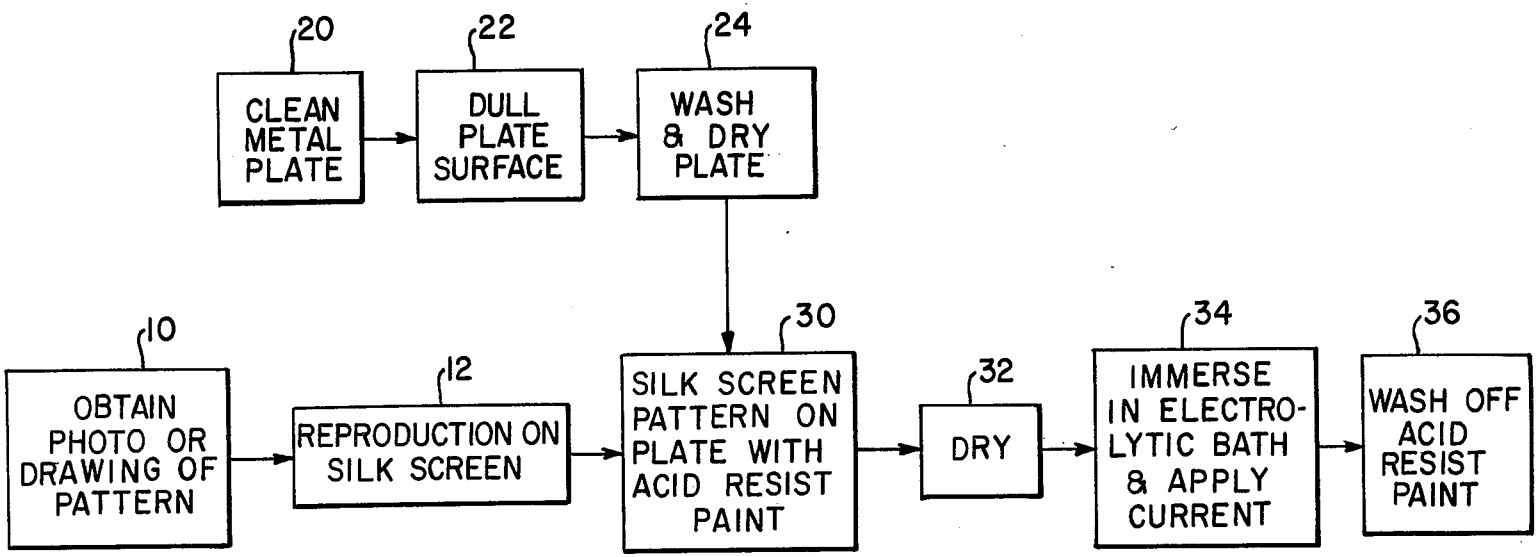
10
OBTAIN PHOTO OR DRAWING OF PATTERN
12
REPRODUCTION ON SILK SCREEN
20
CLEAN METAL PLATE
22
DULL PLATE SURFACE
24
WASH & DRY PLATE
30
SILK SCREEN PATTERN ON PLATE WITH ACID RESIST PAINT
32
DRY
34
IMMERSE IN ELECTRO-LYTIC BATH & APPLY CURRENT
36
WASH OFF ACID RESIST PAINT

PROCESS FOR ENGRAVING METAL PLATES TO BE USED AS PATTERNS FOR TEXTURIZED PRODUCTS

This invention relates to a process for engraving metal plates, including stainless steel plates, to be used as patterns for pressed materials, such as texturized plastic panels, texturized glass, texturized ceramic materials, texturized particle plates, texturized wood fiber plates, and other similar articles.

Various methods for engraving metal plates are known. Some of these methods have the disadvantage that they do not permit very great engraving depths to be attained in the metal plate, which results in that the relief portions are not outstanding and, therefore, a neat appearance in the texturized products cannot be obtained.

Other processes, although providing reasonable engraving depths, do not permit the making of large size engraved metal plates, as required, for example, in the production of texturized wood fiber plates or panels.

Other processes permit engraved metal plates with the desired depth to be obtained in large size plates. However, the time spent for carrying out the engraving is too long, thus making the product excessively expensive. Other processes do not permit engraving stainless steel plates.

According to the present invention, it is possible to obviate all the above-mentioned disadvantages and obtain engraved metal plates as large as 10 meters long×3.0 meters wide or more. In addition, the engraving depth can be easily controlled, permitting the level desired to be obtained.

The novel process according to the invention for engraving metal plates is based on the electro-erosion, by using as an anode the plate to be engraved, and as a cathode a plate of the same material or any other suitable material adequately chosen, and by causing an electric current to pass between the anode and the cathode, through an appropriate ionic solution.

By this electro-erosion process, the anode wears out and the eroded material is deposited on the cathode or remains in the solution, depending on the material used as the cathode.

FIG. 1 is a flow diagram of the invention. Below there is a description of the invention, through a series of examples which are not intended to be limitative, but which can vary in many aspects; all of them, however, are included within the scope of the basic inventive idea.

EXAMPLE 1

This example relates to the engraving of a stainless steel metal plate to be used as a pattern in the making of texturized wood fiber plates. The dimensions of such metal plate may be, for instance, 6.0×2.3 meters×¼" thick. The example comprises a certain number of steps which are described as follows:

1. The pattern to be reproduced on the wood fiber plate or other article may be obtained through a photograph or drawing specially worked out and photographed by means of conventional methods. This is shown in block 10. In both cases, depending on the desired depth of engraving, a correction factor is applied, enlarging or reducing the photograph so that the traces in the metal plate have the final dimensions desired.

2. The photograph or drawing obtained is reproduced on a silk screen, previously made photosensitive. This is shown in block 12. The technique for the obtention of this reproduction is fully known and, therefore, it will not be discussed in detail.
3. To carry out the engraving, the metal plate is completely cleaned free of grease or dust. This is shown in block 20. Cleaning is accomplished by any suitable chemical cleaner with the plate thereafter being washed.
4. In addition, for the engraving and for the perfect fixation of the paint in the metal plate, the latter must have its surface specially treated so as to obtain a slight and uniform dull, or roughened, taint. This dull appearance is obtained by applying an iron perchloride or other suitable chemical solution in the case of stainless steel, or an adequate special solution in the case of other metals. This is shown in block 22. The solution slightly pits the surface. After the application of the dulling solution, the metal plate is thoroughly washed and dried. This is shown in block 24.
5. The pattern to be engraved on the metal plate is placed thereon by normal serigraphic processes, by using, to this effect, the previously stamped silk screen. This is shown in block 30. The serigraphic ink or paint used must be specially acid-resistant. A suitable paint is one having an acrylic base.
6. After the ink or paint is completely dry, which may require some period of time depending on the ambient temperature and the grade of the serigraphic ink or paint employed, the metal plate to be engraved is sent to a tank where the electrolysis will take place. The drying step is shown in block 32.
7. The electrolytic bath is composed of one part of an inorganic acid, such as sulphuric acid, hydrochloric acid or any other one, and from one to ten parts of water as pure as possible, depending on the type of metal to be engraved and on the conditions in question. In the case of stainless steel, hydrochloric acid is applied in a concentration varying from 5% to 15%, depending on the speed and on the desired engraving quality. The bath also has therein a second plate of the same or similar material.

The temperature of the bath is maintained constant, preferably between 20° and 50° C., with maximum variations of about 5° C. A continuous electric current is passed between the plate with the pattern thereon and the second plate, with a current density of 1.0 to 25 amperes per square decimeter of unpainted area, voltage of 01 to 10 volts, for the time required to obtain the desired engraving depth. This time varies by some minutes to some hours. This is shown in block 34.

On the region of the plate not containing acid-resistant ink or paint, the material will begin to be eroded to form the desired depressions, according to the pattern to be engraved.

The engraving depth can be controlled taking as a basis the time during which the plate remains in the solution, and will always be homogeneous.

Once this operation is completed, the plate is removed from the bath, is hot-washed in a 10% sodium hydroxide solution, whereupon the ink or paint is removed. This is shown in block 36.

Now the plate is ready to be used as a pattern for the production of texturized wood fiber plates or other articles.

The same bath can be reused for several engraving operations, by maintaining the same acid-water proportion.

EXAMPLE 2

This is identical to Example 1, with the exception that there are obtained in the same plate engravings with different depths. In this case, all steps from 1 to 7 of Example 1 are carried out in a similar manner. In step 5, the pattern to be laid down on the metal is first laid on the surface area which is to be fully protected and not eroded at all. From this point, the process is continued as follows.

The plate is removed from the bath after the smallest depth required is eroded, and is washed in clean water. All the region or surface not to be further eroded to a greater depth is covered with acid-resistant paint, such as that used for transferring the pattern from the silk screen.

After the paint is dried, the plate is introduced again in the bath, the same current density and voltage being maintained. Of course, the region or surface not containing any paint will be attacked and eroded, the depth of the engraving being increased as deep as the desired level.

The plate is again removed from the bath, and the region or surface not to be eroded to a greater depth is covered with acid-resistant paint. This process continues until all desired depths are attained.

What is claimed is:

1. Method for engraving metal plates to be used for producing texturized articles with a pattern comprising the steps of:

making a silk screen of the pattern to be engraved on a said metal plate, dulling the surface of said plate by applying a solution thereto, laying down on the plate by screening from the silk screen an acid-resist material reproduction of the pattern, providing a bath of inorganic acid selected from the group consisting of sulfuric acid and hydrochloric acid, providing an electrode in said bath, immersing the area of the plate to be engraved in said bath, and applying an electric current, in the range of from about one to about twenty-five amperes per square decimeter of area which is not covered by the acid-resist material, said current having a voltage in the range of from about one to about ten volts, between said plate and said electrode to erode the plate by electrochemical action in the immersed areas not covered by the acid-resist material.

2. Method according to claim 1 wherein said plate is of stainless steel, wherein the surface of said plate is dulled by applying a solution comprising iron perchloride in the range of about 5%, and wherein said inorganic acid has a concentration ranging from about one to about ten parts of water.

* * * * *